US007475583B2

(12) United States Patent
Kim et al.

(10) Patent No.: US 7,475,583 B2
(45) **Date of Patent: *Jan. 13, 2009**

(54) METHOD FOR REPAIRING METAL PIPE

(75) Inventors: Honggie Kim, Santa Fe Springs, CA (US); Russell McFarland, Burbank, CA (US)

(73) Assignee: State Pipe & Supply, Inc., Santa Fe Springs, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/308,453

(22) Filed: Mar. 27, 2006

(65) Prior Publication Data

US 2007/0175260 A1 Aug. 2, 2007

Related U.S. Application Data

(60) Provisional application No. 60/764,271, filed on Feb. 1, 2006.

(51) Int. Cl.
*B21D 41/02* (2006.01)
*B21D 17/02* (2006.01)
*B21D 39/08* (2006.01)

(52) U.S. Cl. ..... 72/370.01; 72/370.06; 72/392

(58) Field of Classification Search ..... 72/367.1, 72/370.01, 370.06, 370.07, 370.08, 392, 72/409.17, 466; 405/184.3, 184.1; 138/97
See application file for complete search history.

(56) References Cited

U.S. PATENT DOCUMENTS 423,544 A * 3/1890 Vanderman ..... 72/466
1,033,687 A * 7/1912 Fish ..... 72/392
2,205,784 A * 6/1940 Arutunoff ..... 72/31.03
2,345,443 A * 3/1944 Aiken ..... 72/466
2,545,878 A * 3/1951 Forrest ..... 72/406
2,818,102 A * 12/1957 Seifferle ..... 72/392
3,422,659 A * 1/1969 Warrick ..... 72/429
3,581,546 A * 6/1971 Ragettli ..... 72/353.6
3,618,897 A * 11/1971 Swoboda et al. ..... 254/270
3,783,674 A * 1/1974 Hinerman ..... 72/476
4,004,444 A * 1/1977 Pollart ..... 72/370.08
4,715,204 A * 12/1987 Ottlik ..... 72/76
4,727,744 A * 3/1988 Ferree ..... 72/466
4,727,745 A * 3/1988 Ferree ..... 72/478
5,485,739 A * 1/1996 Grimmett ..... 72/466
5,634,361 A * 6/1997 Herschman et al. ..... 72/31.02
2007/0177946 A1 * 8/2007 Kim et al. ..... 405/184.3

* cited by examiner

*Primary Examiner*—Dana Ross
*Assistant Examiner*—Teresa Bonk
(74) *Attorney, Agent, or Firm*—Park Law Firm; John K. Park

(57) ABSTRACT

A method for repairing metal pipe with dents includes steps of a) holding the pipe with first and second ends in position; b) dragging the mandrel through the pipe; and c) pushing out the dents from inside to an original level of the surface of the pipe. The cross-section of the mandrel has a substantially same cross-section of the hollow space of a undamaged pipe, and the outer surface of the major portion of the mandrel fits tightly to the inside of the undamaged pipe. The step of holding the pipe includes steps of a) guiding the pipe into a locking position; b) stopping the pipe along the direction of the axis of the pipe; and c) stopping the pipe along the perpendicular direction of the axis of the pipe.

16 Claims, 12 Drawing Sheets

METHOD FOR REPAIRING METAL PIPE

RELATED APPLICATION

This application is a corresponding non-provisional application of U.S. Provisional Patent Application Ser. No. 60/764,271 for "Method and System for Repairing Metal Pipe" filed on Feb. 1, 2006.

BACKGROUND OF THE INVENTION

The present invention relates to a system for repairing metal pipe.

More particularly, this invention relates to a method for repairing metal pipe damaged with dents.

Prior to the present invention, all pipe sizes 3", and under that were damaged were scrapped.

Metal pipes of 4" and larger were repaired by using a jack system that was very labor intensive. Actually, there are very few repair services available in the pipe industry. The lead time of the major steel service centers to get material repaired was in excess of 4-6 months. During all those long time period the damaged pipe would sit out in the yard rusting to the point that it was no longer considered prime material. This is another reason why many companies would opt to reject in full damaged material.

On all pipe received at the harbor 30% damage is minimum for schedule 10 wall thickness. Lighter walls have in excess of 40% damage.

Insurance companies typically will not insure a product that consistently has more that 10 to 20% damage rate.

Using the present invention, 99% of all damaged material (1¼" to 6" nominal) is not able to be repaired in the schedule 10 and under wall thicknesses.

Thousands of feet of pipe can be straightened and have dents removed daily.

Lower insurance premiums will be realized as fewer claims are registered.

Repair cost of 4" and 6" pipe are reduced greatly.

1¼" to 3" are now repaired and returned to stock and sold as new material.

We will be able to open new profit centers that repair pipe for companies that import material that suffers damage.

Accordingly, a need for a method for repairing metal pipe has been present for a long time considering the range of pipe use in the modern industrial society. This invention is directed to solve the problems and satisfy the long-felt need.

SUMMARY OF THE INVENTION

The present invention contrives to solve the disadvantages of the prior art.

An object of the invention is to provide a method for repairing a damaged pipe.

Another object of the invention is to provide a method for repairing a damaged pipe, which can push out the dents and remove the damage from the pipe.

A method for repairing metal pipe with dents includes steps of a) holding the pipe with first and second ends in position; b) dragging the mandrel through the pipe; and c) pushing out the dents from inside to an original level of the surface of the pipe.

The cross-section of the mandrel has a substantially same cross-section of the hollow space of a undamaged pipe, and the outer surface of the major portion of the mandrel fits tightly to the inside of the undamaged pipe.

The step of holding the pipe includes steps of a) guiding the pipe into a locking position along the direction of the axis of the pipe; b) stopping the pipe along the direction of the axis of the pipe against pressure imparted by momentum transfer from the friction between the pipe and the mandrel; and c) stopping the pipe along the perpendicular direction of the axis of the pipe against pressure imparted by momentum transfer from the friction between the pipe and the mandrel.

The step of guiding the pipe includes a step of using a bevel surface.

The step of stopping the pipe along the direction of the axis of the pipe includes a step of using a stopping surface connected to the bevel surface.

The step of stopping the pipe along the perpendicular direction of the axis of the pipe includes a step of using a plurality of V-shaped pipe rests and a plurality of hydraulic rams.

The step of dragging the mandrel through the pipe includes a step of pulling the mandrel using a winch connected to the mandrel with a cable.

The step of dragging the mandrel through the pipe includes a step of pushing the mandrel with a pushing rod.

The step of dragging the mandrel through the pipe includes a step of lubricating the contacting surface between the pipe and the mandrel.

The method may further include steps of a) connecting the mandrel to the cable before the step of dragging the mandrel through the pipe; b) putting a mandrel into the first end of the pipe before the step of dragging the mandrel through the pipe; c) pulling out the mandrel from the inside of the pipe at the second end after the step of pushing out the dents from inside; and d) disconnecting the mandrel from the cable after the step of pushing out the dents from inside.

The method may further include a step of delivering the mandrel from the second end of the pipe to the first end of the pipe.

The step of delivering the mandrel includes a step of using a slope, and the slope tilts from the second end to the first end.

The method may further include a step of using a system for repairing a pipe damaged with dents, which includes a pipe holding device, a mandrel, a cable, and a winch.

The pipe holding device is for holding the pipe in position.

The mandrel, with a cross section and size adapted to be pulled through the interior of the pipe, has a first edge, a second edge, and a side surface.

The cable has first and second ends, and the first end is detachably attached to the first edge of the mandrel.

The winch is connected to the second end of the cable for winding up the cable.

The mandrel is pulled by the winch with the cable and travels through the pipe to push out from inside and remove the dents on the surface of the pipe.

The pipe holding device includes a processing deck, an overhanging deck, and a pipe stopper.

The processing deck, for supporting the pipe in position, includes a lower beam with first and second ends and a plurality of pipe rests provided on the lower beam.

The overhanging deck, for holding and positioning the pipe, includes an upper beam and a plurality of hydraulic rams extending down from the upper beam.

The pipe stopper is for aligning and stopping the pipe against the force exerted by the mandrel driven by the winch.

The lower beam of the processing deck and the upper beam of the overhanging deck are made of a fabricated I beam. The dimension of the I beam is determined by the dimension of the damaged pipe. The I beam is approximately thirty five (35)

feet long, approximately twelve (12) inches wide, and approximately seven (7) inches high.

The pipe rest of the processing deck is substantially V shaped.

The hydraulic ram comprises an arm extending from the upper beam and a pinning hand provided at the end of the arm. The pinning hand is substantially V-shaped.

The pipe stopper includes a bevel surface and a stopping surface, and the bevel surface and the stopping surface are adapted to align and stop the edge of the pipe. The bevel surface and the stopping surface meet each other in approximately from one hundred thirty five (135) to one hundred forty five (145) degrees.

The mandrel includes a tapered head part, a barrel part, and a mechanical fastener.

The tapered head part provided at the first edge, and the diameter is smoothly increasing.

The barrel part, with a diameter accommodating the inner diameter of the pipe, is connected to the tapered head part, provided on the side surface.

The mechanical fastener, for detachably attaching the cable, is provided at the end of the tapered head part.

The mechanical fastener includes a female screw thread.

Alternatively, the mechanical fastener includes a hooking device, in which case the cable includes a looping device adapted to the hooking device.

The winch includes a hydraulic pump. The hydraulic pump is driven by an electrical motor. The hydraulic pump may sense the pressure from the load, and the operation of the electrical motor is controlled by the sensed pressure accordingly.

The system for repairing pipe may further include a feeding rack, a discharge rack, and a slope.

The feeding rack is for feeding the pipes one by one to the processing deck. The discharge rack is for discharging the processed pipes out of the processing deck. The slope, for returning the mandrel, is tilted downward from the finishing end to the starting end.

The system for repairing pipe may further include a lubricant for reducing the friction and wear between the inner surface of the pipe and the side surface of the barrel part of the mandrel.

The advantages of the present invention are: (1) the system for repairing metal pipe makes it possible to repair metal pipe damaged with dents; and (2) it takes a short time for the system to repair the metal pipe, which enables to handle a truck load of pipes in a reasonable time span.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIG. 4 is a perspective view of a system for repairing metal pipe according to the present invention;

DETAILED DESCRIPTION OF THE INVENTION

The U.S. Provisional Patent Application Ser. No. 60/764,271 by the applicant is incorporated by reference into this disclosure as if fully set forth herein.

Figure 1:
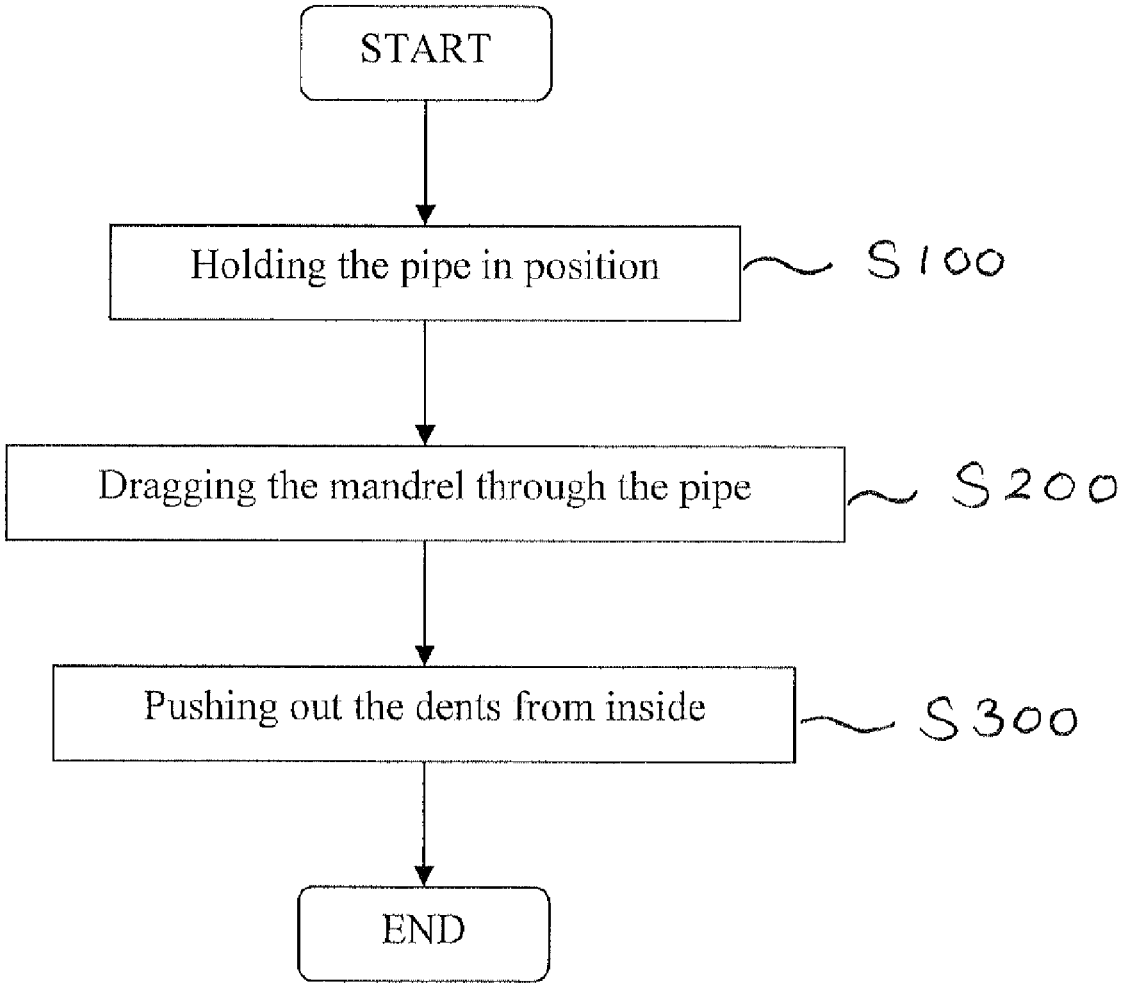
FIG. 1 is a flow chart of a method for repairing metal pipe according to the invention.
Figure 2:
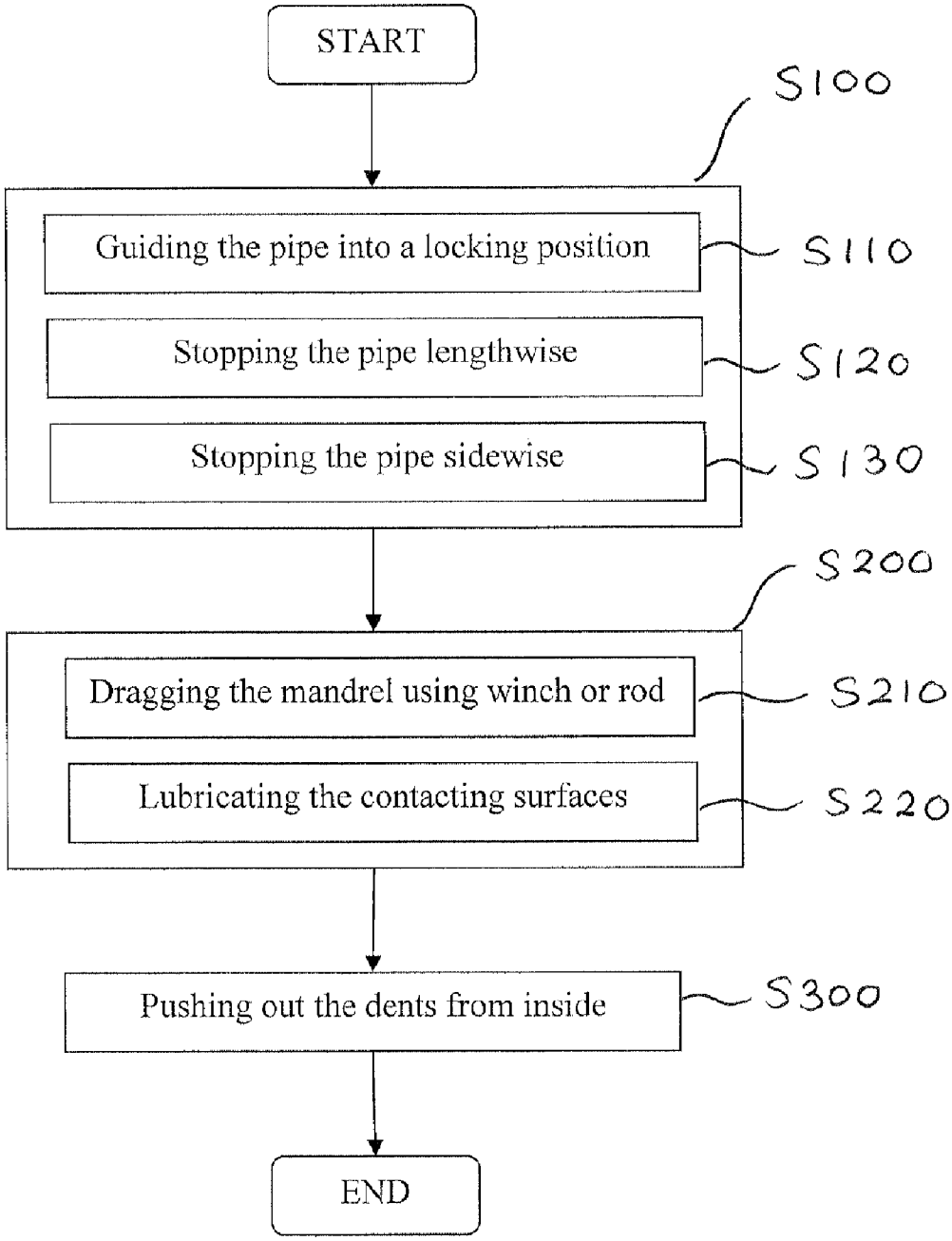
FIG. 2 is another flow chart of a method.
Figure 3:
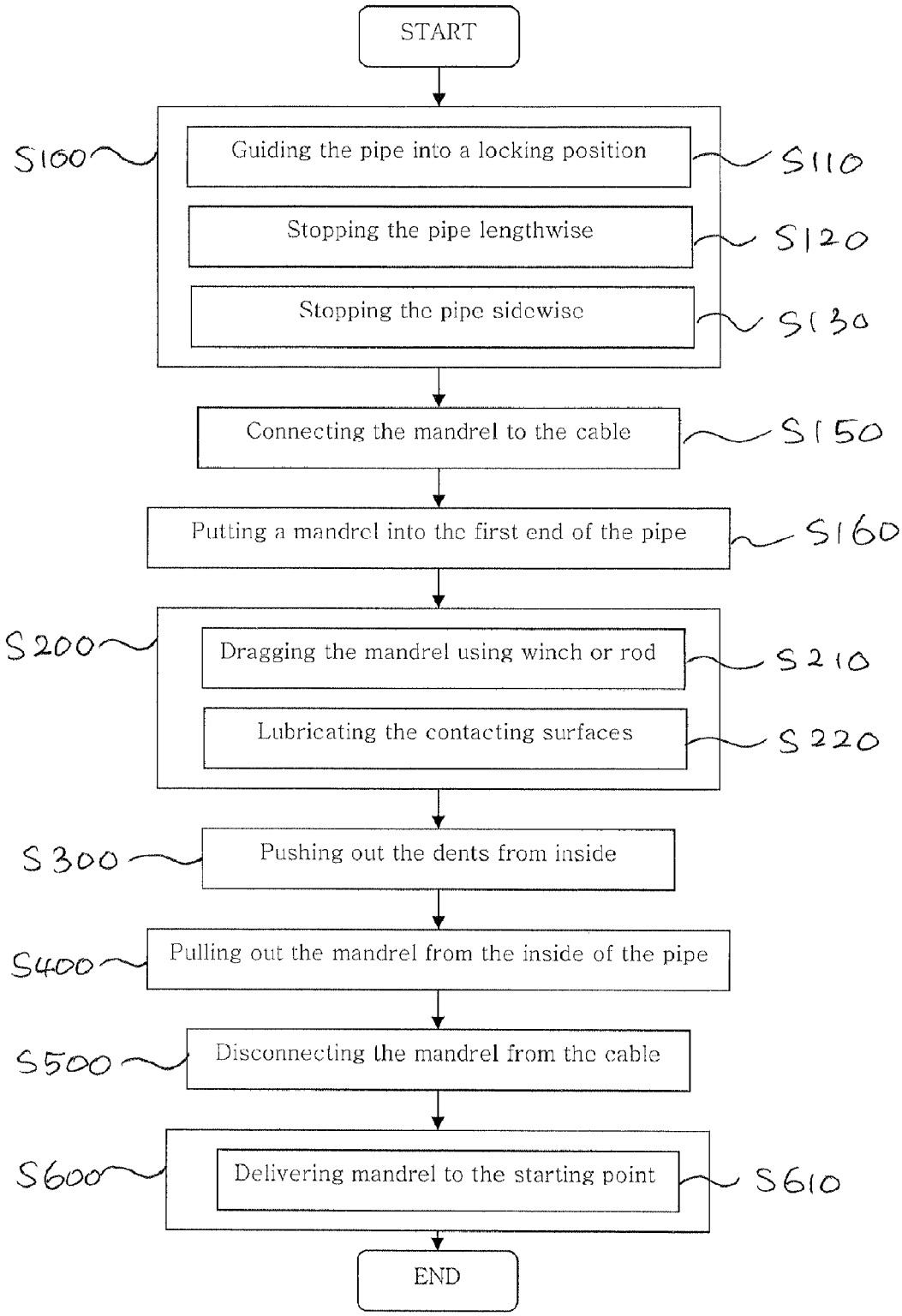
FIG. 3 is still another flow chart of the method.
Figure 2:
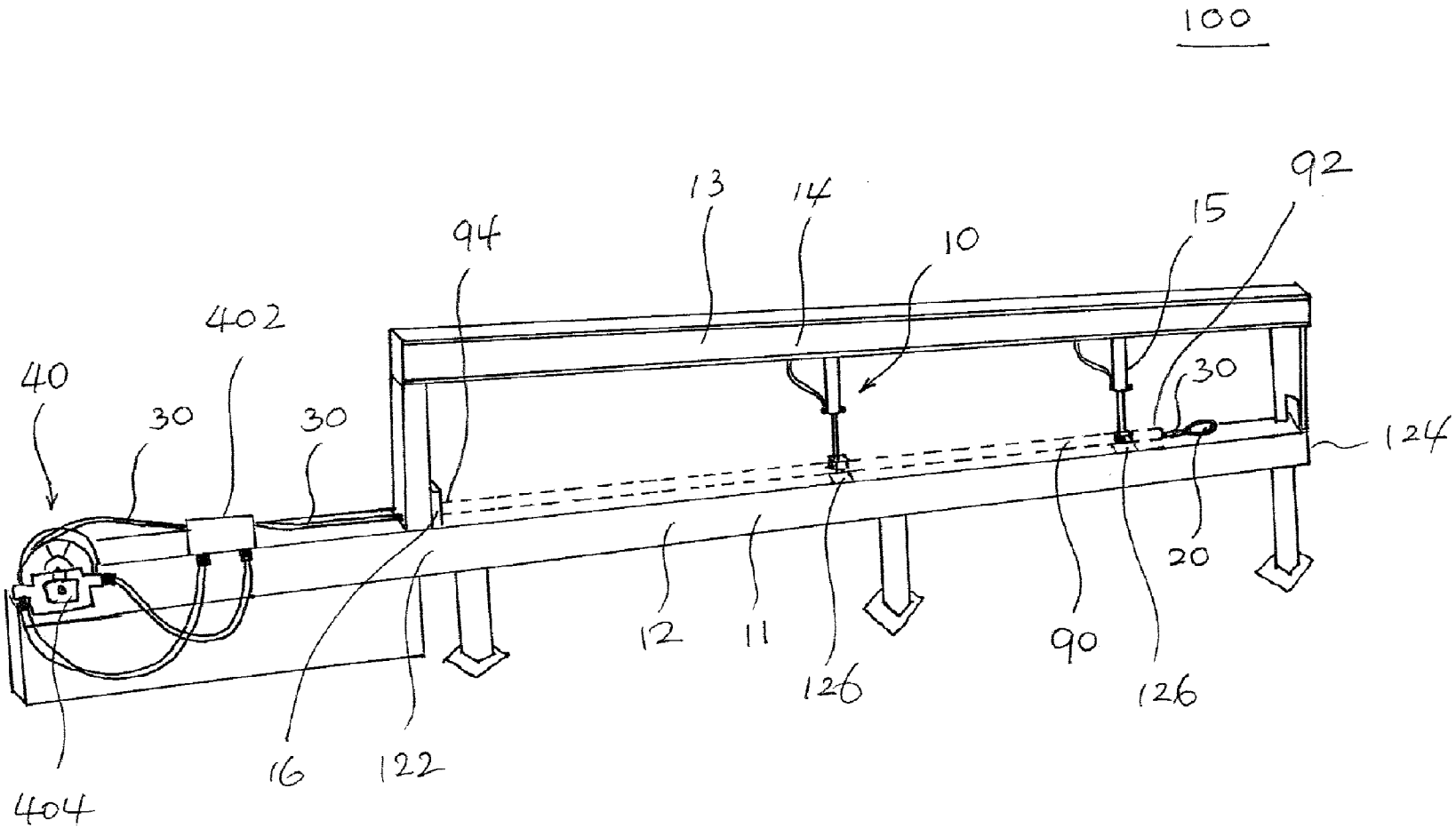

FIGS. 1 through 3 show flow charts for a method for repairing a damaged pipe 90 according to the present invention. FIGS. 4 through 14 show a system for the method.

A method for repairing metal pipe 90 with dents 91 includes steps of a) holding the pipe 90 with first and second ends 92, 94 in position (S100); b) dragging the mandrel 20 through the pipe 90 (S200); and c) pushing out the dents 91 from inside to an original level of the surface of the pipe 90 (S300).

The cross-section of the mandrel 20 has a substantially same cross-section of the hollow space of a undamaged pipe 90, and the outer surface of the major portion of the mandrel 20 fits tightly to the inside of the undamaged pipe 90.

The step (S100) of holding the pipe includes steps of a) guiding the pipe 90 into a locking position along the direction of the axis of the pipe 90 (S101); b) stopping the pipe 90 along the direction of the axis of the pipe 90 against pressure imparted by momentum transfer from the friction between the pipe 90 and the mandrel 20 (S120); and c) stopping the pipe 90 along the perpendicular direction of the axis of the pipe 90 against pressure imparted by momentum transfer from the friction between the pipe 90 and the mandrel 20 (S130).

Figure 9:
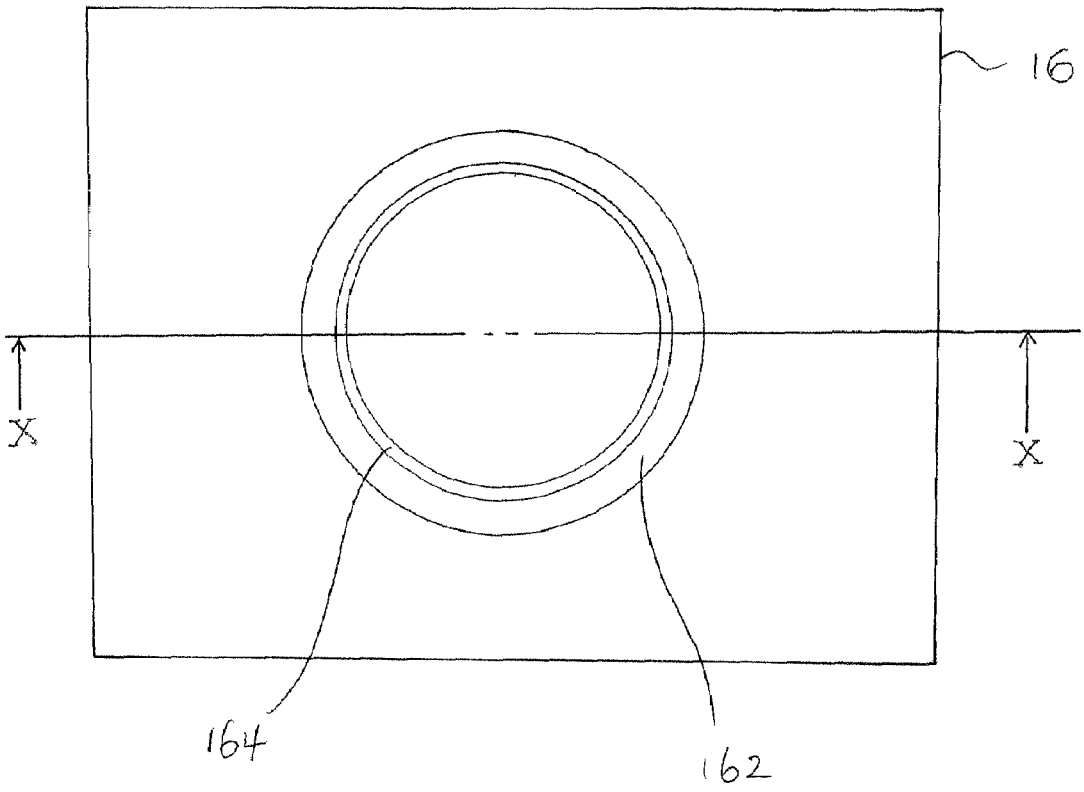
FIG. 9 is a front plan view of a pipe stopper.

The step (S110) of guiding the pipe 90 includes a step of using a bevel surface 162 as shown in FIG. 9.

The step (S120) of stopping the pipe 90 along the direction of the axis of the pipe 90 includes a step of using a stopping surface 164 connected to the bevel surface 162.

Figure 7:
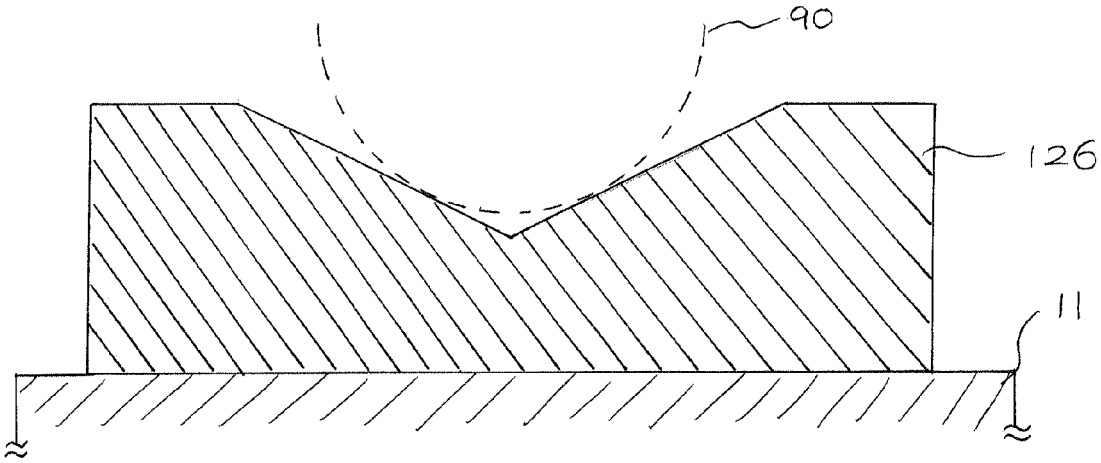
FIG. 7 is a cross-sectional view of a pipe rest.
Figure 8:
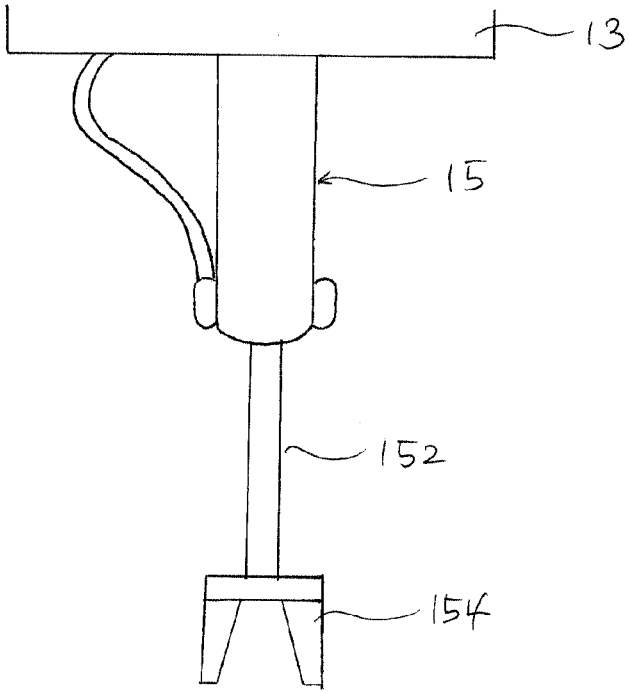
FIG. 8 is a front plan view of a pipe holding device.

The step (S120) of stopping the pipe 90 along the perpendicular direction of the axis of the pipe 90 includes a step of using a plurality of V-shaped pipe rests 126 and a plurality of hydraulic rams 152 as shown in FIG. 7 and FIG. 8.

The step (S200) of dragging the mandrel 20 through the pipe 90 includes a step (S210) of pulling the mandrel 20 using a winch 40 connected to the mandrel 20 with a cable 30 as shown in FIG. 2

The step (S200) of dragging the mandrel 20 through the pipe 90 includes a step (S210) of pushing the mandrel 20 with a pushing rod (not shown) as shown in FIG. 2.

The step (S200) of dragging the mandrel 20 through the pipe 90 includes a step (S220) of lubricating the contacting surface between the pipe 90 and the mandrel 20.

The method may further include steps of a) connecting the mandrel 20 to the cable 30 (S150) before the step of dragging the mandrel through the pipe 90 (S200); b) putting a mandrel 20 into the first end of the pipe 90 (S160) before the step of dragging the mandrel 20 through the pipe 90 (S200); c) pulling out the mandrel 20 from the inside of the pipe 90 at the second end (S400) after the step of pushing out the dents 91 from inside (S300); and d) disconnecting the mandrel 20 from the cable 30 (S500) after the step of pushing out the dents 91 from inside (S300) as shown in FIG. 3.

The method may further include a step (S600) of delivering the mandrel 20 from the second end of the pipe 90 to the first end of the pipe 90.

The step (S600) of delivering the mandrel 20 includes a step (S610) of using a slope 70, and the slope 70 tilts from the second end 94 to the first end 92.

The method may further include a step of using a system 100 for repairing a pipe 90 damaged with dents 91, which includes a pipe holding device 10, a mandrel 20, a cable 30, and a winch 40 as shown in FIGS. 4 through 14.

FIG. 4 shows a perspective view of a system 100 for repairing metal pipe 90 according to the present invention The system 100 for repairing a pipe damaged with dents 91 (refer to FIG. 6) includes a pipe holding device 10, a mandrel 20, a cable 30, and a winch 40.

The pipe holding device 10 is for holding the pipe 90 in position.

Figure 5:
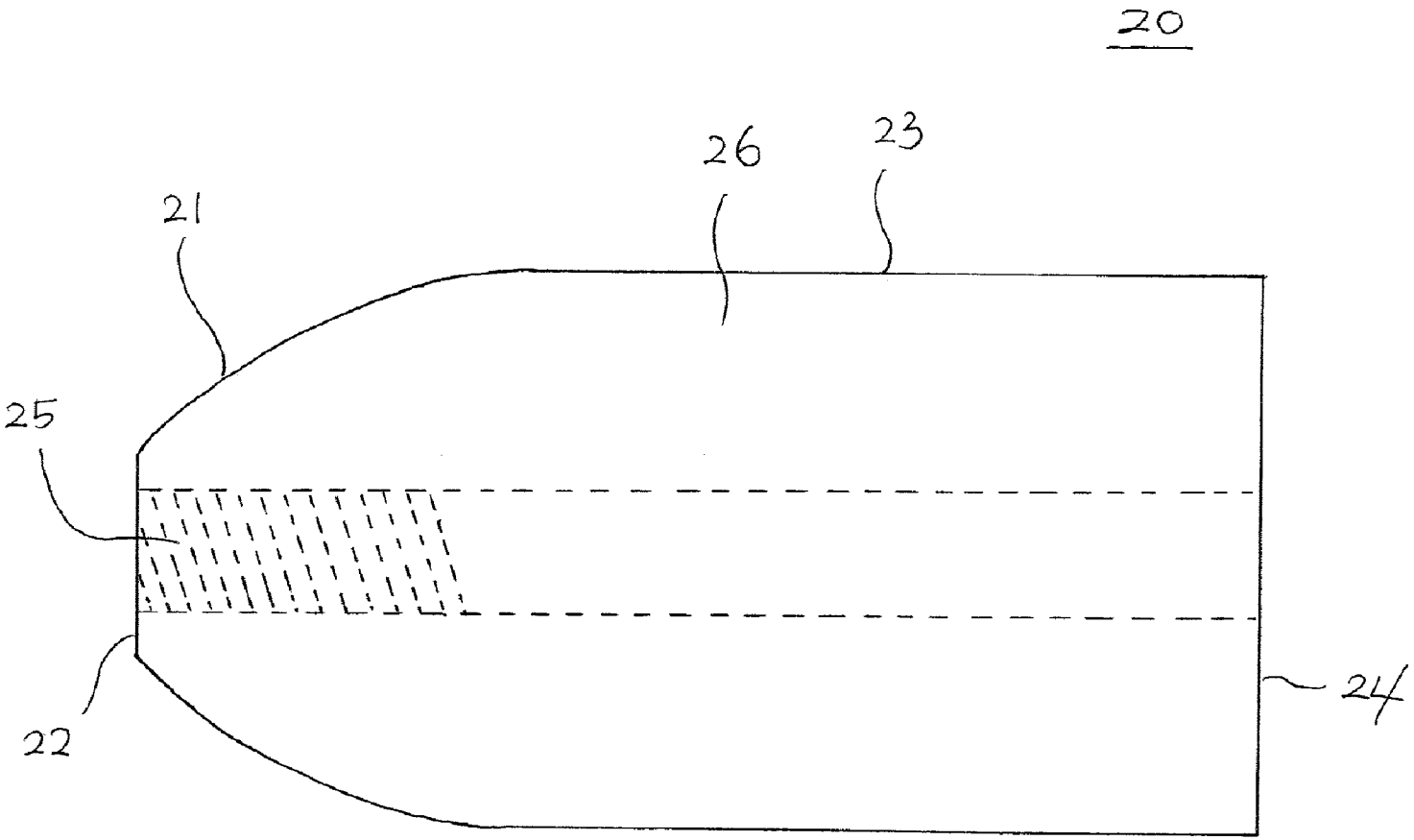
FIG. 5 is a side plan view of an embodiment of a mandrel according to the present invention.

The mandrel 20, with a cross section and size adapted to be pulled through the interior of the pipe 90, has a first edge 22, a second edge 24, and a side surface 26 as shown in FIG. 5.

Figure 6:
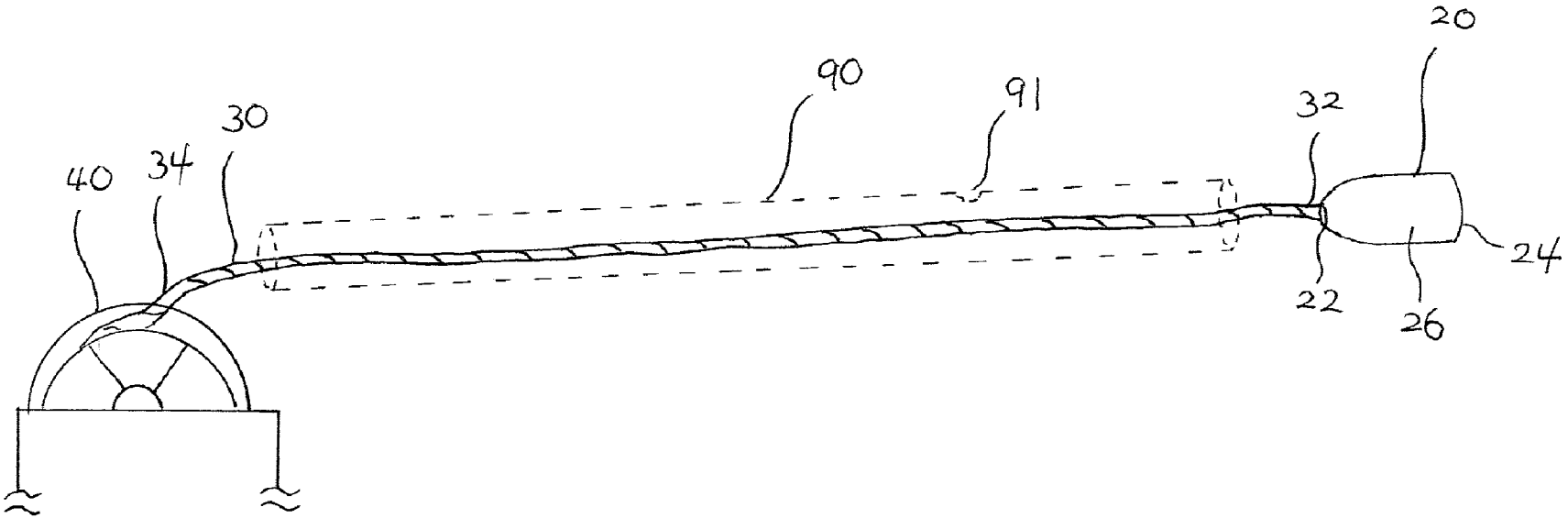
FIG. 6 is a schematic view showing the relations between a damaged pipe, a mandrel, a cable, and a winch.

The cable 30 has first and second ends 32, 34, and the first end 32 is detachably attached to the first edge 22 of the mandrel 20 as shown in FIG. 6.

The winch 40 is connected to the second end 34 of the cable for winding up the cable 30 as shown in FIG. 6.

The mandrel 20 is pulled by the winch 40 with the cable 30 and travels through the pipe 90 to push out from inside and remove the dents 91 on the surface of the pipe 90 as shown in FIG. 6.

The pipe holding device 10 includes a processing deck 12, an overhanging deck 14, and a pipe stopper 16 as shown in FIG. 4.

The processing deck 12, for supporting the pipe 90 in position, includes a lower beam 11 with first and second ends 122, 124 and a plurality of pipe rests 126 provided on the lower beam 11.

The overhanging deck 14, for holding and positioning the pipe 90, includes an upper beam 13 and a plurality of hydraulic rams 15 extending down from the upper beam 13.

The pipe stopper 16 is for aligning and stopping the pipe 90 against the force exerted by the mandrel 20 driven by the winch 40.

The lower beam 11 of the processing deck 12 and the upper beam 13 of the overhanging deck 14 are made of a fabricated I beam. The dimension of the I beam is determined by the dimension of the damaged pipe 90. The I beam is approximately thirty five (35) feet long, approximately twelve (12) inches wide, and approximately seven (7) inches high.

The pipe rest 126 of the processing deck 12 is substantially V shaped as shown in FIG. 7.

The hydraulic ram 15 comprises an arm 152 extending from the upper beam 13 and a pinning hand 154 provided at the end of the arm 152. The pinning hand 154 is substantially V-shaped as shown in FIG. 8.

Figure 10:
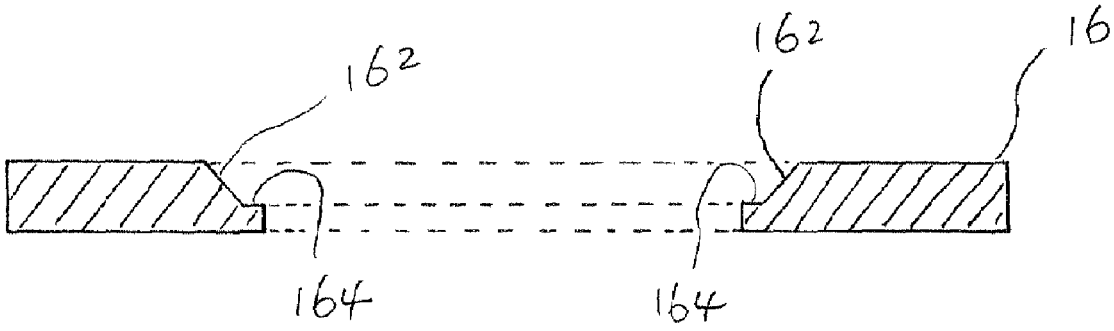
FIG. 10 is a cross-sectional view of the pipe stopper along the line X-X of FIG. 9.

The pipe stopper 16 includes a bevel surface 162 and a stopping surface 164, and the bevel surface 162 and the stopping surface 164 are adapted to align and stop the edge of the pipe 90. The bevel surface 162 and the stopping surface 164 meet each other in approximately from one hundred thirty five (135) to one hundred forty five (145) degrees as shown in FIG. 9 and FIG. 10.

The mandrel 20 includes a tapered head part 21, a barrel part 23, and a mechanical fastener 25.

The tapered head part 21 provided at the first edge 22, and the diameter is smoothly increasing.

The barrel part 23, with a diameter accommodating the inner diameter of the pipe 90, is connected to the tapered head part 21, provided on the side surface 26.

The mechanical fastener 25, for detachably attaching the cable 30, is provided at the end of the tapered head part 21.

The mechanical fastener 25 includes a female screw thread as shown in FIG. 5.

Figure 11:
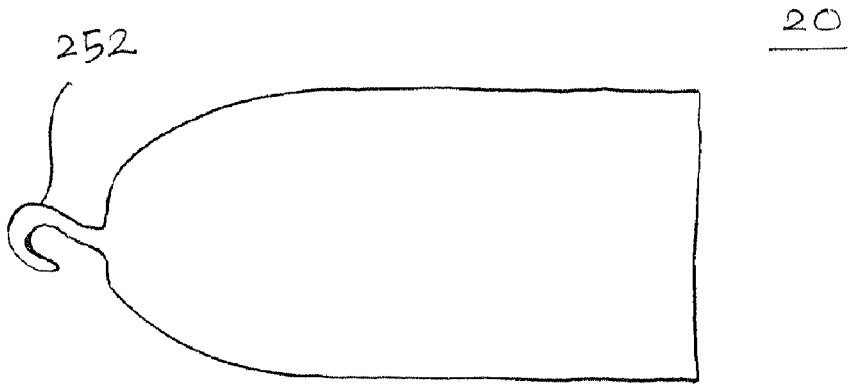
FIG. 11 is a side plan view of another embodiment of a mandrel.
Figure 12:
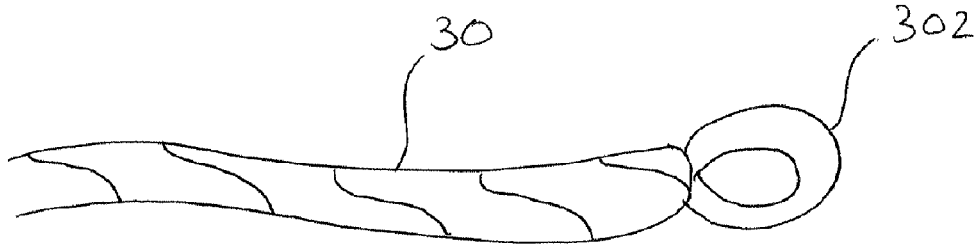
FIG. 12 shows a first end of a cable corresponding mandrel of FIG. 11.

Alternatively, the mechanical fastener 25 includes a hooking device 252, in which case the cable 30 includes a looping device 302 adapted to the hooking device 252 as shown in FIG. 11 and FIG. 12.

The winch 40 includes a hydraulic pump 402. The hydraulic pump 402 is driven by an electrical motor 404. The hydraulic pump 402 may sense the pressure from the load, and the operation of the electrical motor 404 is controlled by the sensed pressure accordingly.

Figure 13:
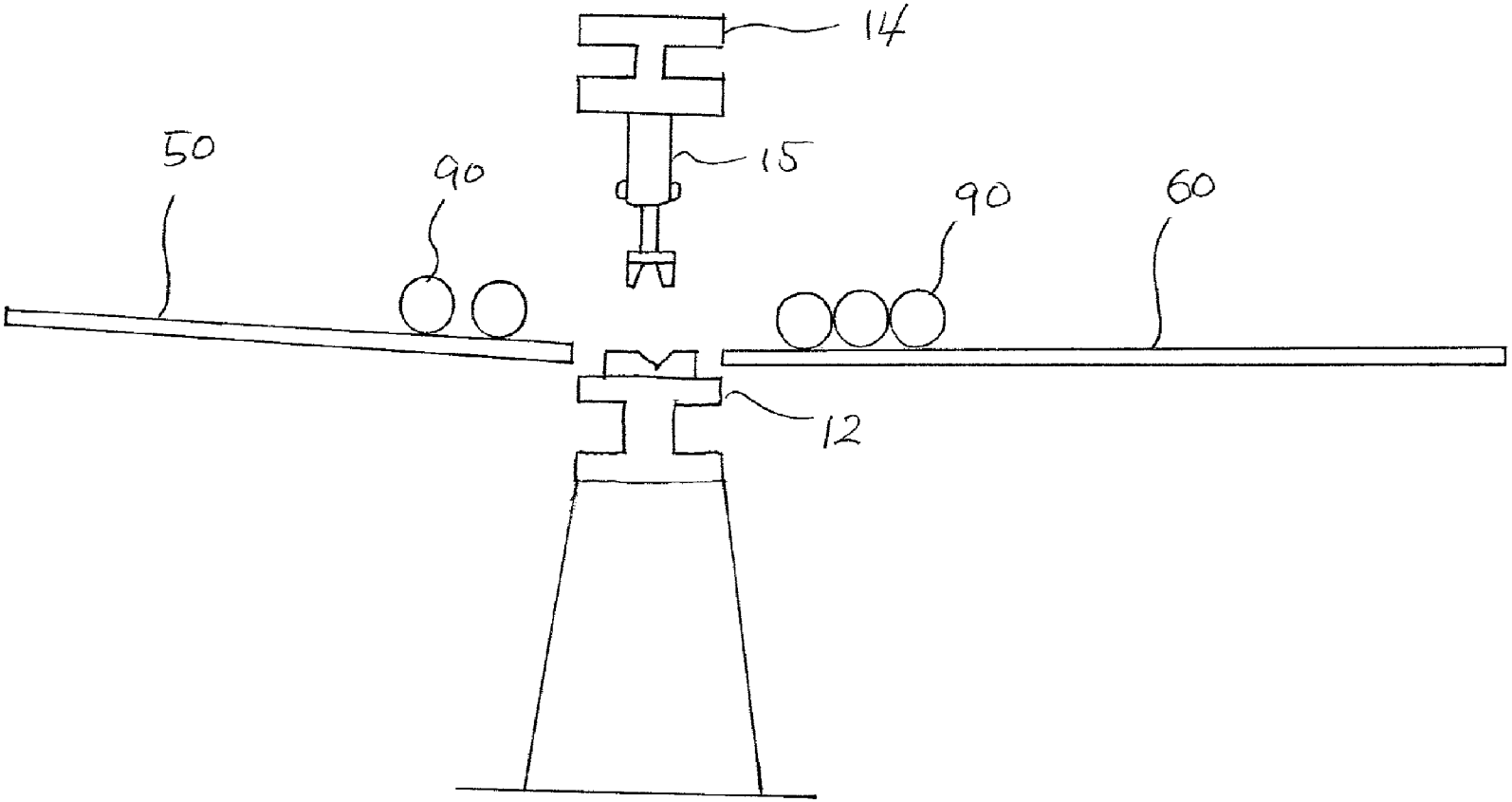
FIG. 13 is a front view of a system according to the present invention with a feeding rack and a discharge rack.

The system 100 for repairing pipe may further include a feeding rack 50, a discharge rack 60, and a slope 70 as shown in FIG. 13.

Figure 14:
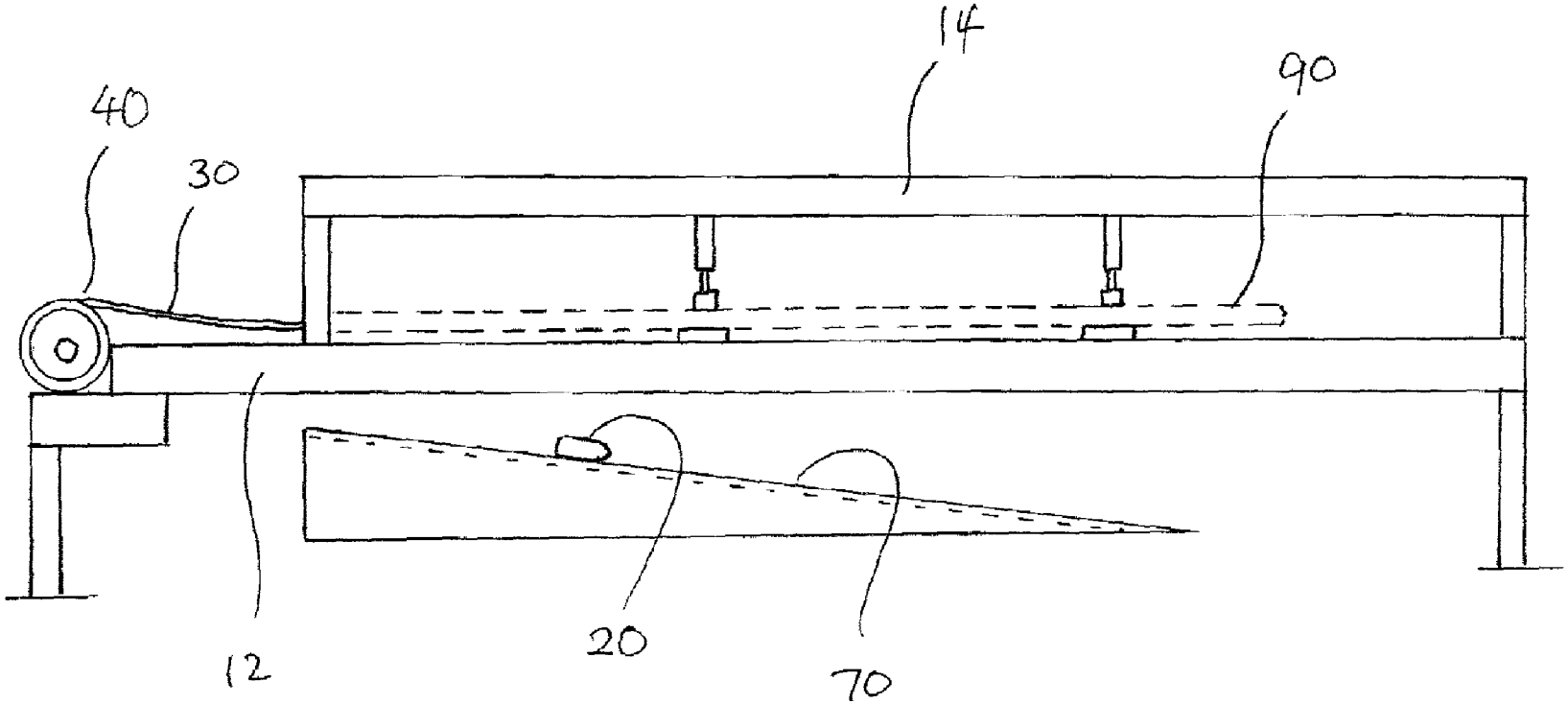
FIG. 14 is a side view of a system with a slope for returning the mandrel.

The feeding rack 50 is for feeding the pipes 90 one by one to the processing deck 12. The discharge rack 60 is for discharging the processed pipes 90 out of the processing deck 12. The slope 70, for returning the mandrel 20, is tilted downward from the finishing end to the starting end as shown in FIG. 14. The mandrel 20 must be detached from the cable 30 and then brought to the finishing end, the far side from the winch 40 after the travel through the pipe 90 in order to be attached to the cable queued through next damaged pipe 90.

The system for repairing pipe may further include a lubricant for reducing the friction and wear between the inner surface of the pipe and the side surface of the barrel part of the mandrel.

In an embodiment of the system according to the present invention, the system specifications may include the followings:

Hydraulically driven by a 60 gallon per minute, 2500 psi, variable pump, pressure compensated.

Electric motor to run the hydraulics is 50 hp, 440 three phase.

Winch will pull up #12,000 of horizontal force and capable of 135 feet per minute.

Mandrels are machined out of 1080 shaft steel and carbonized for hardening.

Main winch drive in manually controlled and pipe hold down clamps are actuated by electric controls.

The mandrel connected to the end of the wire cable is driven through the damaged pipe for repairing or pushing out the dents. The mandrel travels from the first end the pipe to the second end of the pipe, and must be brought back to the first end of a new pipe to repair. Actually, the mandrel is very heavy. Therefore, the system may further include a tilted slope, provided just by the rack, with a greased rail for sliding the mandrel from the second end to the first end using the universal gravity.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A method for repairing metal pipe with dents comprising steps of:

a) holding the pipe with first and second ends in position;

b) dragging a mandrel through the pipe; and c) pushing out the dents from inside to an original level of the surface of the pipe, wherein a cross-section of the mandrel has a substantially same cross-section of a hollow space of a undamaged pipe, wherein an outer surface of the major portion of the mandrel fits tightly to the inside of the undamaged pipe, wherein the step of holding the pipe comprises steps of:

guiding the pipe into a locking position along the direction of the an axis of the pipe;

stopping the pipe along the direction of the axis of the pipe against pressure imparted by momentum transfer from the friction between the pipe and the mandrel; and stopping the pipe along the perpendicular direction of the axis of the pipe against pressure imparted by momentum transfer from the friction between the pipe and the mandrel, wherein the step of stopping the pipe along the perpendicular direction of the axis of the pipe comprises a step of using a plurality of V-shaped pipe rests and a plurality of hydraulic rams.

2. The method of claim 1, wherein the step of guiding the pipe comprises a step of using a bevel surface.

3. The method of claim 2, wherein the step of stopping the pipe along the direction of the axis of the pipe comprises a step of using a stopping surface connected to the bevel surface.

4. The method of claim 1, wherein the step of dragging the mandrel through the pipe comprises a step of pulling the mandrel using a winch connected to the mandrel with a cable.

5. The method of claim 1, wherein the step of dragging the mandrel through the pipe comprises a step of pushing the mandrel with a pushing rod.

6. The method of claim 1, wherein the step of dragging the mandrel through the pipe comprises a step of lubricating the contacting surface between the pipe and the mandrel.

7. The method of claim 1, further comprising steps of:

a) connecting the mandrel to a cable before the step of dragging the mandrel through the pipe;

b) putting a mandrel into the first end of the pipe before the step of dragging the mandrel through the pipe;

c) pulling out the mandrel from the inside of the pipe at the second end after the step of pushing out the dents from inside; and d) disconnecting the mandrel from the cable after the step of pushing out the dents from inside.

8. A method for repairing metal pipe with dents comprising steps of:

a) holding the pipe with first and second ends in position;

b) dragging the a mandrel through the pipe; and c) pushing out the dents from inside to an original level of the surface of the pipe, wherein the a cross-section of the mandrel has a substantially same cross-section of the a hollow space of a undamaged pipe, wherein the an outer surface of the major portion of the mandrel fits tightly to the inside of the undamaged pipe, wherein the method further comprises a step of delivering the mandrel from the second end of the pipe to the first end of the pipe, wherein the step of delivering the mandrel comprises a step of using a slope, wherein the slope tilts from the second end to the first end.

9. A method for repairing metal pipe with dents comprising steps of:

a) holding the pipe with first and second ends in position;

b) dragging a mandrel through the pipe; and c) pushing out the dents from inside to an original level of the surface of the pipe, wherein a cross-section of the mandrel has a substantially same cross-section of a hollow space of a undamaged pipe, wherein an outer surface of the major portion of the mandrel fits tightly to the inside of the undamaged pipe, wherein the method further comprises a step of using a system for repairing a pipe damaged with dents, wherein the system includes:

a) a pipe holding do vice for holding the pipe in position;

b) a mandrel, with a cross section and size adapted to he pulled through the interior of the pipe, having a first edge, a second edge, and a side surface;

c) a cable having first and second ends, wherein the first end is detachably attached to the first edge of the mandrel; and d) a winch connected to the second end of the cable for winding up the cable, wherein the mandrel is pulled by the winch with the cable, wherein the mandrel travels through the pipe to push out from inside and remove the dents on the surface of the pipe, wherein the pipe holding device comprises:

a) a processing deck, for supporting the pipe in position, comprising a lower beam with first and second ends and a plurality of pipe rests provided on the lower beam;

b) an overhanging deck, for holding and positioning the pipe, comprising an upper beam and a plurality of hydraulic rams extending down from the upper beam; and c) a pipe stopper for aligning and stopping the pipe against the force exerted by the mandrel driven by the winch.

10. The method of claim 9, wherein the lower beam of the processing deck and the upper beam of the overhanging deck are made of a fabricated I beam, wherein the dimension of the I beam is determined by the dimension of the damaged pipe, wherein the I beam is approximately thirty five (35) feet long, approximately twelve (12) inches wide, and approximately seven (7) inches high.

11. The method of claim 9, wherein the pipe rest of the processing deck is substantially V shaped, wherein the hydraulic ram comprises an arm extending from the upper beam and a pinning hand provided at the end of the arm, wherein the pinning hand is substantially V-shaped.

12. The method of claim 9, wherein the pipe stopper comprises a bevel surface and a stopping surface, wherein the bevel surface and the stopping surface are adapted to align and stop the edge of the pipe, wherein the bevel surface and the stopping surface meet each other in approximately from one hundred thirty five (135) to one hundred forty five (145) degrees.

13. The method of claim 9, wherein the mandrel comprises:

a) a tapered head part provided at the first edge, wherein the diameter is smoothly increasing;

b) a barrel part, with a diameter accommodating the inner diameter of the pipe, connected to the tapered head part, provided on the side surface; and c) a mechanical fastener, for detachably attaching the cable, provided at the end of the tapered head part, wherein the mechanical fastener comprises a female screw thread, wherein the mechanical fastener comprises a hooking device, wherein the cable comprises a looping device adapted to the hooking device.

14. The method of claim 9, wherein the winch comprises a hydraulic pump, wherein the hydraulic pump is driven by an electrical motor, wherein the hydraulic pump senses the pressure from the load, wherein the operation of the electrical motor is controlled by the sensed pressure.

15. A method for repairing metal pipe with dents comprising steps of:

a) holding the pipe with first and second ends in position;

b) dragging mandrel through the pipe; and c) pushing out the dents from inside to an original level of the surface of the pipe, wherein a cross-section of the mandrel has a substantially same cross-section of a hollow space of a undamaged pipe, wherein an outer surface of the major portion of the mandrel fits tightly to the inside of the undamaged pipe, wherein the method further comprises a step of using a system for repairing a pipe damaged with dents, wherein the system includes:

a) a pipe holding device for holding the pipe in position;

b) a mandrel, with a cross section arid size adapted to be pulled through the interior of the pipe, having a first edge, a second edge, and a side surface;

c) a cable having first and second ends, wherein the first end is detachably attached to the first edge of the mandrel; and d) a winch connected to the second end of the cable for winding up the cable, wherein the mandrel is pulled by the winch with the cable, wherein the mandrel travels through the pipe to push out from inside and remove the dents on the surface of the pipe, wherein the system further comprises:

a) a feeding rack for feeding the pipes one by one to the processing deck;

b) a discharge rack for discharging the processed pipes out of the processing deck; and c) a slope, for returning the mandrel, tilting downward from the finishing end to the starting end.

16. The method of claim 9, further comprising a step of using a lubricant for reducing the friction and wear between the inner surface of the pipe and the side surface of the barrel part of the mandrel.

* * * * *